US012466531B1

(12) United States Patent
Novak

(10) Patent No.: US 12,466,531 B1
(45) Date of Patent: Nov. 11, 2025

(54) MARINE DRIVE LOWER UNIT HAVING SEAL DEVICE

(71) Applicant: Brunswick Corporation, Mettawa, IL (US)

(72) Inventor: Aaron J. Novak, North Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 495 days.

(21) Appl. No.: 17/980,969

(22) Filed: Nov. 4, 2022

(51) Int. Cl.
*B63H 20/32* (2006.01)
*B63H 20/02* (2006.01)

(52) U.S. Cl.
CPC ..... *B63H 20/32* (2013.01); *B63H 20/02* (2013.01); *B63H 2020/025* (2013.01); *B63H 2020/323* (2013.01)

(58) Field of Classification Search
CPC .. B63H 20/32; B63H 20/02; B63H 2020/025; B63H 2020/323
See application file for complete search history.

(56) References Cited

U.S. PATENT DOCUMENTS

| | | | |
|---|---|---|---|
| 1,764,388 | A | 6/1930 | Buchet |
| 2,247,671 | A | 7/1941 | Tepel |
| 2,545,086 | A | 3/1951 | Harris |
| 2,877,733 | A | 3/1959 | Harris |
| 3,052,204 | A | 9/1962 | Scivally |
| 4,066,032 | A | 1/1978 | Calvin |
| 4,226,432 | A | 10/1980 | Nakamizo |
| 4,267,401 | A | 5/1981 | Wilkinson |
| 4,632,487 | A | 12/1986 | Wargula |
| 4,744,777 | A | 5/1988 | Ferguson |
| 5,114,352 | A | 5/1992 | Gahagen et al. |
| 5,197,910 | A | 3/1993 | Kanno et al. |
| 5,235,138 | A | 8/1993 | Shah et al. |
| 5,445,545 | A | 8/1995 | Draper |

(Continued)

FOREIGN PATENT DOCUMENTS

| | | |
|---|---|---|
| DE | 102019213702 A1 | 3/2021 |
| EP | 775630 | 5/1997 |
| FR | 2542518 | 3/1938 |

OTHER PUBLICATIONS

Amphenol. Sell sheet for Radlok product line. Document created Oct. 23, 2014.

(Continued)

*Primary Examiner* — Stephen P Avila
(74) *Attorney, Agent, or Firm* — Andrus Intellectual Property Law, LLP

(57) ABSTRACT

A marine drive has a supporting frame for coupling the marine drive to a marine vessel, a gearcase supporting a propulsor for propelling the marine vessel in water, an electric motor in the gearcase, the electric motor being configured to rotate the propulsor, an extension leg between the supporting frame and the gearcase, a tube in the extension leg, the tube extending between an upper end and a lower end which is coupled to the gearcase, an electrical connector extending through the tube and providing power to the electric motor, and a seal device providing a watertight seal between the electrical connector and the tube or an extension thereof to thereby prevent infiltration of water to the gearcase.

21 Claims, 10 Drawing Sheets

(56) References Cited

U.S. PATENT DOCUMENTS

| | | | |
|---|---|---|---|
| 5,510,577 | A | 4/1996 | Corrigan |
| 5,831,217 | A | 11/1998 | Jarvis et al. |
| 6,521,840 | B1 | 2/2003 | Kreutz |
| 6,923,134 | B1 | 8/2005 | Vrudny et al. |
| 6,966,806 | B1 | 11/2005 | Bruestle et al. |
| 7,435,147 | B1 | 10/2008 | Eichinger |
| 7,452,251 | B2 | 11/2008 | Boebel |
| 7,659,699 | B2 | 2/2010 | Boebel |
| 8,043,135 | B1 | 10/2011 | Corn |
| 8,337,264 | B2 | 12/2012 | Boebel |
| 8,529,305 | B2 | 9/2013 | Lin |
| 8,628,091 | B2 | 1/2014 | Davidson |
| 9,446,830 | B2 | 9/2016 | Hartmeyer et al. |
| 9,481,435 | B1 | 11/2016 | Jaszewski et al. |
| 9,490,619 | B2 | 11/2016 | Smith |
| 9,630,694 | B1 | 4/2017 | Jaszewski |
| 9,701,383 | B1 | 7/2017 | Stuber et al. |
| 9,718,526 | B2 | 8/2017 | Biebach et al. |
| 9,789,946 | B2 | 10/2017 | Biebach et al. |
| 9,815,541 | B2 | 11/2017 | Biebach et al. |
| 9,853,465 | B2 | 12/2017 | Biebach et al. |
| 9,896,172 | B1 | 2/2018 | Pugh |
| 9,963,213 | B1 | 5/2018 | Jaszewski et al. |
| 10,096,863 | B2 | 10/2018 | Hartmeyer et al. |
| 10,124,870 | B2 | 11/2018 | Bergmann et al. |
| 10,263,361 | B1 | 4/2019 | Gretz |
| 10,266,244 | B2 | 4/2019 | Bergmann et al. |
| 10,343,759 | B2 | 7/2019 | Despineux |
| 10,351,220 | B1 | 7/2019 | Witte |
| 10,384,757 | B2 | 8/2019 | Mueller et al. |
| 10,421,363 | B2 | 9/2019 | Biebach |
| 10,472,036 | B2 | 11/2019 | Spengler et al. |
| 10,556,659 | B2 | 2/2020 | Biebach et al. |
| 10,647,398 | B2 | 5/2020 | Biebach |
| 10,862,087 | B2 | 12/2020 | Hartmeyer |
| 10,926,853 | B2 | 2/2021 | Despineux et al. |
| 10,981,637 | B1 | 4/2021 | Alby et al. |
| 11,001,360 | B2 | 5/2021 | Basler |
| 11,021,224 | B2 | 6/2021 | Biebach |
| 11,040,761 | B2 | 6/2021 | Biebach et al. |
| 11,066,141 | B2 | 7/2021 | Despineux et al. |
| 11,091,241 | B2 | 8/2021 | Despineux et al. |
| 11,155,322 | B2 | 10/2021 | Baros |
| 11,572,145 | B1 | 2/2023 | Andrasko |
| 11,866,137 | B1 | 1/2024 | Jaszewski |
| 2007/0197107 | A1* | 8/2007 | Lee ..... B63H 20/007 440/6 |
| 2009/0269994 | A1 | 10/2009 | Alston |
| 2020/0017183 | A1 | 1/2020 | He et al. |
| 2022/0017201 | A1* | 1/2022 | Takeda ..... B63H 1/14 |
| 2023/0182880 | A1 | 6/2023 | Jaszewski |
| 2023/0257095 | A1 | 8/2023 | Waldvogel |

OTHER PUBLICATIONS

Amphenol. Sell sheet for SurLok product line. Document created Oct. 23, 2014.

Declaration of Prior Art, Feb. 10, 2022.

EPropulsion Brand Products found online at https://www.epropulsion.com/who-we-are/, accessed Feb. 9, 2022.

Fergus, et al. Unpublished U.S. Appl. No. 17/487,116, filed Sep. 28, 2021.

Jaszewski, et al. Unpublished U.S. Appl. No. 17/550,463, filed Dec. 14, 2021.

Sawyer, et al. Unpublished U.S. Appl. No. 17/469,479, filed Sep. 8, 2021.

Schmidt, et al. Unpublished U.S. Appl. No. 17/585,214, filed Jan. 26, 2022.

Schrank, et al. Unpublished U.S. Appl. No. 17/509,739, filed Oct. 25, 2021.

Seta, et al. Unpublished U.S. Appl. No. 17/554,540, filed Dec. 17, 2021.

Extended European Search Report for EP Application No. 2220682938, dated May 15, 2023.

Extended European Search Report for EP Application No. 23154210.1, dated Jul. 19, 2023.

* cited by examiner

MARINE DRIVE LOWER UNIT HAVING SEAL DEVICE

FIELD

The present disclosure relates to marine drives for propelling a marine vessel in water.

BACKGROUND

The following U.S. patents are incorporated by reference in entirety.

U.S. Pat. No. 10,981,637 discloses an apparatus for supporting an outboard motor on a transom of a marine vessel. The apparatus has a transom bracket configured for fixed attachment to the transom; a supporting cradle that supports the outboard motor with respect to the transom bracket, wherein the supporting cradle is pivotable with respect to the transom bracket about a trim axis; and a trim actuator that is pivotally coupled to the transom bracket at a first trim actuator pivot axis and to the supporting cradle at a second trim actuator pivot axis. Extension of the trim actuator pivots the supporting cradle upwardly about the trim axis. Retraction of the trim actuator pivots the supporting cradle downwardly about the trim axis. The trim axis is located aftwardly of the first trim actuator pivot axis.

U.S. Pat. No. 9,963,213 discloses a system for mounting an outboard motor propulsion unit to a marine vessel transom. The propulsion unit's midsection has an upper end supporting an engine system and a lower end carrying a gear housing. The mounting system includes a support cradle having a head section coupled to a transom bracket, an upper structural support section extending aftward from the head section and along opposite port and starboard sides of the midsection, and a lower structural support section suspended from the upper structural support section and situated on the port and starboard sides of the midsection. A pair of upper mounts couples the upper structural support section to the midsection proximate the engine system. A pair of lower mounts couples the lower structural support section to the midsection proximate the gear housing. At least one of the upper and lower structural support sections comprises an extrusion or a casting.

U.S. Pat. No. 9,481,435 discloses an assembly for mounting an outboard motor to a transom of a marine vessel. A support structure is configured to be coupled to the transom by a plurality of fasteners that extend through the support structure and through a set of holes that have been drilled in the transom. A steering head is coupled to the support structure and configured to support an outboard motor thereupon for rotation about a generally vertical steering axis. The set of holes is divided by a generally vertical fore-aft central plane, and the outboard motor extends along a generally vertical fore-aft central plane. The support structure and the steering head are coupled to one another such that the central plane of the outboard motor is capable of being laterally offset from the central plane of the set of holes. An assembly for mounting two or more outboard motors is also provided.

SUMMARY

This Summary is provided to introduce a selection of concepts which are further described herein below in the Detailed Description. This Summary is not intended to identify key or essential features of the claimed subject matter, nor is it intended to be used as an aid in limiting scope of the claimed subject matter.

In non-limiting examples disclosed herein, a marine drive may include a supporting frame for coupling the marine drive to a marine vessel, a gearcase supporting a propulsor for propelling the marine vessel in water, and an electric motor in the gearcase, the electric motor being configured to rotate the propulsor. The marine drive may include an extension leg between the supporting frame and the gearcase and a tube in the extension leg, the tube extending between an upper end and a lower end which is coupled to the gearcase. An electrical connector may extend through the tube and may provide power to the electric motor. A seal device may provide a watertight seal between the electrical connector and the tube or an extension thereof to thereby prevent infiltration of water to the gearcase.

In non-limiting examples disclosed herein, a marine drive may include a supporting frame for coupling the marine drive to a marine vessel, a gearcase supporting a propulsor for propelling the marine vessel in water, an electric motor in the gearcase, the electric motor being configured to rotate the propulsor, an extension leg between the supporting frame and the gearcase, and tube in the extension leg, the tube extending between an upper end and a lower end which is coupled to the gearcase. A plurality of electrical connectors may extend through the tube and providing power and electrical communication to the electric motor. A seal device may provide a watertight seal between the plurality of electrical connectors and the tube or an extension thereof to thereby prevent infiltration of water to the gearcase. The seal device may include rigid members and an elastomeric member which is axially sandwiched between the rigid members, wherein compression of the rigid members on the elastomeric member causes the elastomeric member to radially inwardly and outwardly expand and thereby provide the watertight seal. A fastener may extend through the elastomeric member, wherein tightening the fastener compresses the rigid members on the elastomeric member.

The above examples are contemplated by the present disclosure in various combinations as further described herein below.

BRIEF DESCRIPTION OF THE DRAWINGS

Non-limiting are described with reference to the following drawing figures. The same numbers are used throughout to reference like features and components.

DETAILED DESCRIPTION

The concepts described herein below have been found to be particularly useful in configurations of marine drives having an electric motor located in a lower gearcase and being configured to power a propulsor, such as one or more propeller(s), impeller(s), and/or the like. The illustrated embodiment is just one example of such a marine drive; however the present invention is not limited for use with the illustrated configuration, and in other examples the present invention can be implemented in differently configured marine drives having an internal combustion engine, a hybrid-electric powerhead, and/or the like. The particular configurations of the marine drive shown and described herein below, including the supporting frame, electric motor, and gearcase, are merely exemplary. The present invention is also useful in conjunction with many other marine drive configurations.

Figure 1:
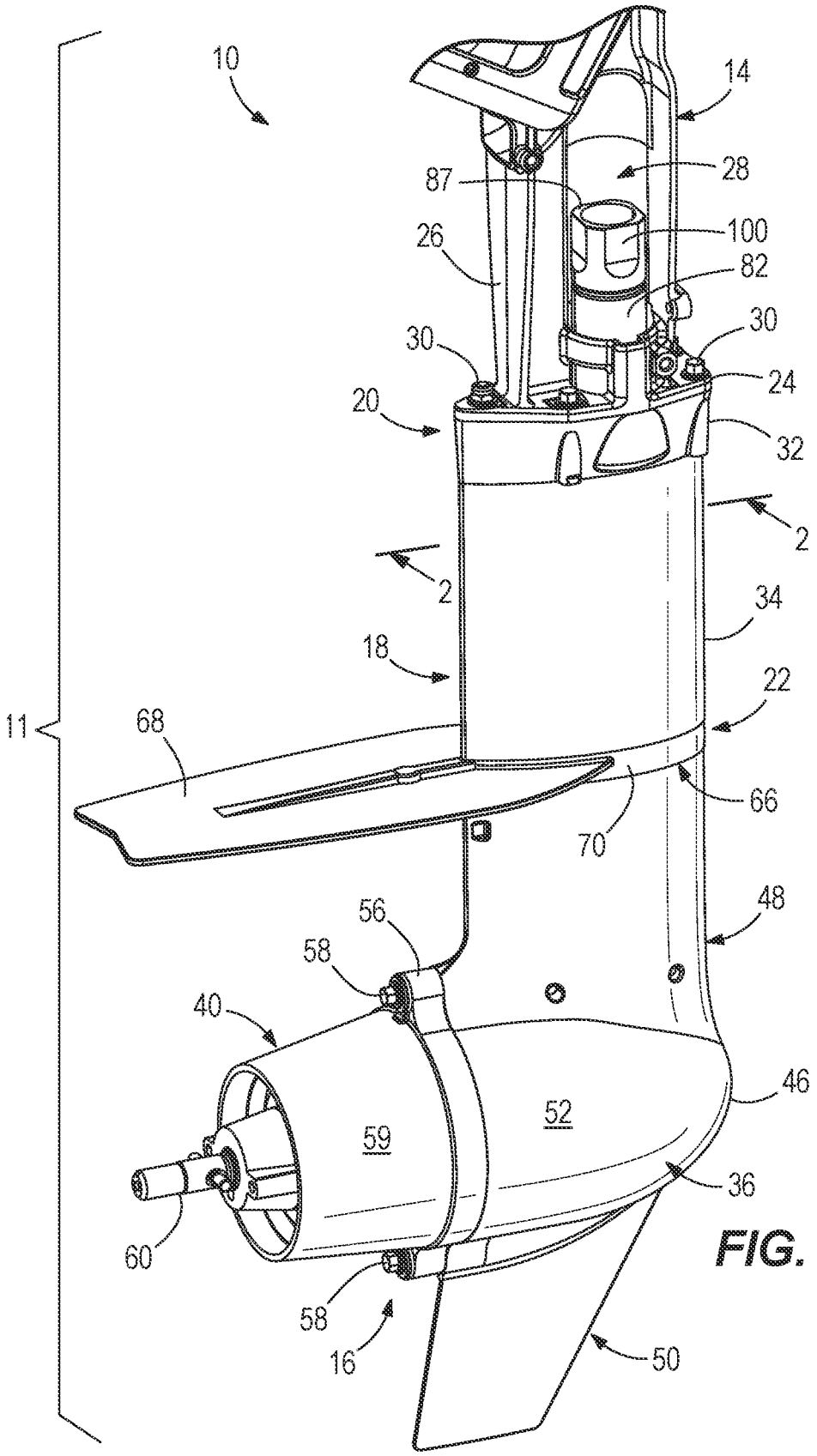
FIG. 1 is a perspective view of a lower unit of a marine drive having an extension leg according to the present disclosure.

FIG. 1 depicts a marine drive 10 for propelling a marine vessel in water. FIG. 1 depicts only lower portions of the marine drive 10. Although not shown, the marine drive 10 also has upper portions, for example one or more upper cowling member(s) which cover an upper supporting frame portion, and/or other conventional apparatuses for supporting various electrical and mechanical components of the marine drive 10. Although not shown, the marine drive 10 is attachable to the marine vessel via for example a conventional transom bracket and/or the like. Some examples of suitable arrangements are provided in the above-incorporated patents, and others are widely commercially available for purchase from Brunswick Corporation and its companies Attwood and Mercury Marine, among others.

In the illustrated embodiment, the marine drive 10 extends from top to bottom in an axial direction AX, from front to back in a longitudinal direction LO which is perpendicular to the axial direction AX, and from side to opposite side in a lateral direction LA which is perpendicular to the axial direction AX and perpendicular to the longitudinal direction LO.

As shown, the marine drive 10 has a lower unit 11 comprised of a supporting frame 14, a gearcase 16, an extension leg 18 which is located axially between the supporting frame 12 and the gearcase 16, an adapter plate 20 which is located between the extension leg 18 and the supporting frame 12, and an anti-ventilation plate 22 which is located axially between the extension leg 18 and the gearcase 16, and extending rearwardly therefrom.

The upper portions of the supporting frame 14 are not shown in the figures and the type and configuration of the supporting frame 14 can vary. The present invention is not limited for use with a particular type of supporting frame. The supporting frame 14 can be any type of supporting frame known in the art for framing and supporting portions of the marine drive, including being configured to support various components of the marine drive, and/or to couple the marine drive to the marine vessel. Examples of various suitable supporting frames for marine drives are provided in the above-incorporated patents.

Figure 2:
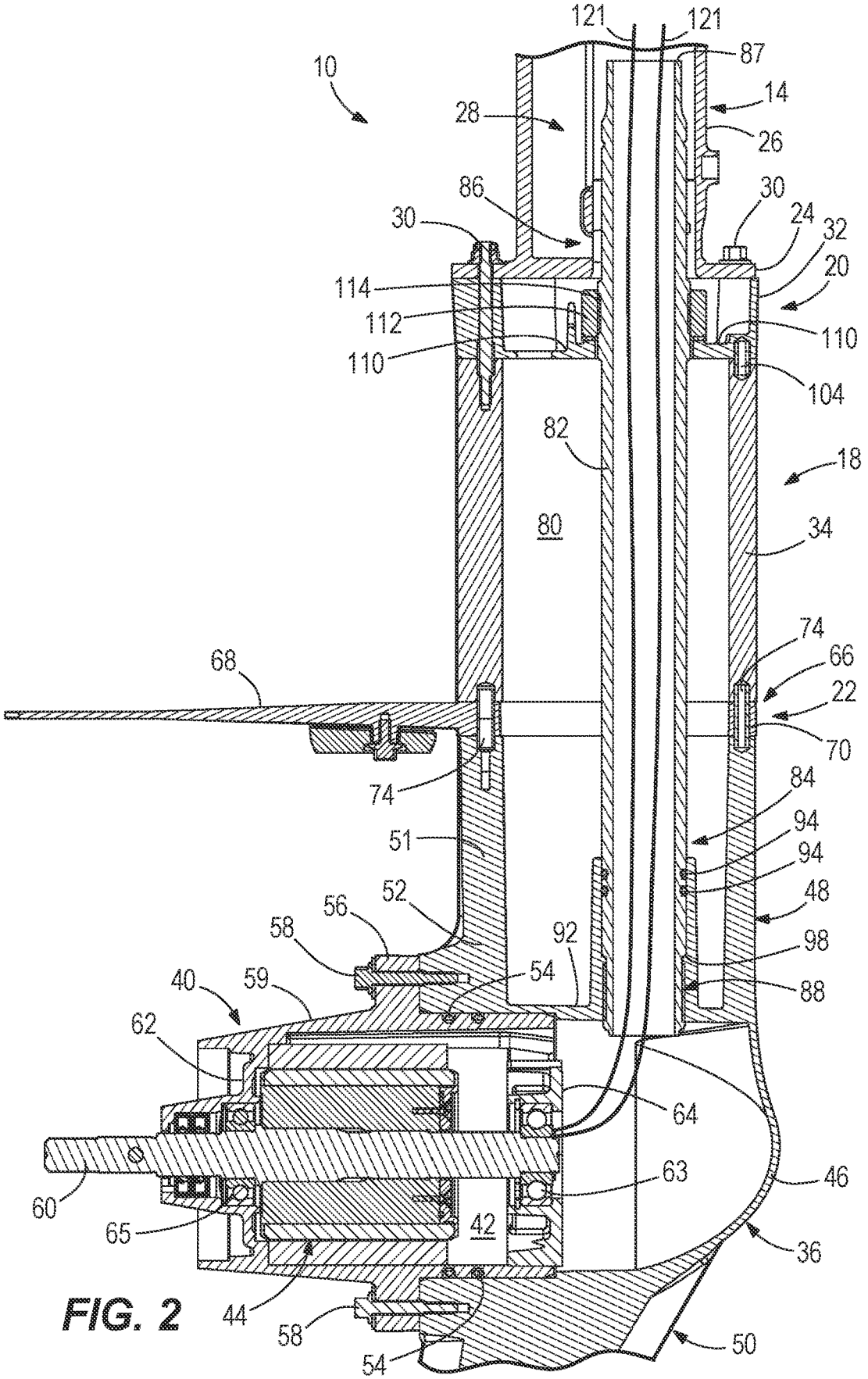
FIG. 2 is a view of section 2-2, taken in FIG. 1.

Referring to FIG. 2, the lower end of the supporting frame 12 has a radial flange 24 which extends from and around the perimeter of the perimeter sidewall 26 of the supporting frame 14. The sidewall 26 of the supporting frame defines an interior passage 28. Fasteners 30 extend through bores in the radial flange 24 and into engagement with bores in the perimeter sidewall 32 of the adapter plate 20. Thus the fasteners 30 fasten the supporting frame 12 to the adapter plate 20.

The gearcase 16 has a front gearcase housing 36 and a rear gearcase housing 40, which together define a gearcase cavity 42 containing an electric motor 44. The front gearcase housing 36 has a nosecone 46 with a smooth outer surface which transitions to an upwardly-facing gearcase housing portion 48 and a downwardly-extending skeg 50. The upwardly-facing gearcase housing portion 48 has a perimeter sidewall 51 which preferably is monolithic so as to avoid visible fasteners or unsightly seams, or can be made of multiple pieces. The nosecone 46 is generally located axially between the upwardly-facing gearcase housing portion 48 and the skeg 50, and protrudes forwardly therefrom. The front gearcase housing 36 further has a rear-facing gearcase housing portion 52 which receives the rear gearcase housing 40 in a nested configuration. O-ring seals 54 are disposed therebetween for limiting water intrusion into the gearcase cavity 42.

The rear gearcase housing 40 has a radially outer flange 56. Fasteners 58 extend through bores in the radially outer flange 56 and into threaded engagement with corresponding bores in the front gearcase housing 36, so as to fasten the rear gearcase housing 40 to the front gearcase housing 36, as shown in a nested arrangement. The rear gearcase housing 40 is generally cylindrical and has a perimeter sidewall 59 which smoothly tapers, radially inwardly at its rear end. The electric motor 44 is also generally cylindrical and is contained within the rear gearcase housing 40, in particular being mounted between a rear end cap 62 and a front end wall 64 of the rear gearcase housing 40. The electric motor 44 causes rotation of an output shaft 60 which longitudinally extends from the rear of the rear gearcase housing 40, through the noted rear end cap 62. The electric motor 44 can be a conventional item, for example an axial flux motor, a radial flux motor, or a transverse flux motor, such as those produced by Electric Torque Machines of Flagstaff, Arizona (a Graco Company). Front and rear bearings 63, 65 support rotation of the output shaft 60 relative to the electric motor 44. A conventional propeller (not shown) is mounted on the outer end of the output shaft 60 such that rotation of the output shaft 60 by the electric motor 44 causes rotation of the propeller, which in turn generates a thrust force for propelling the marine vessel in water.

Figure 3:
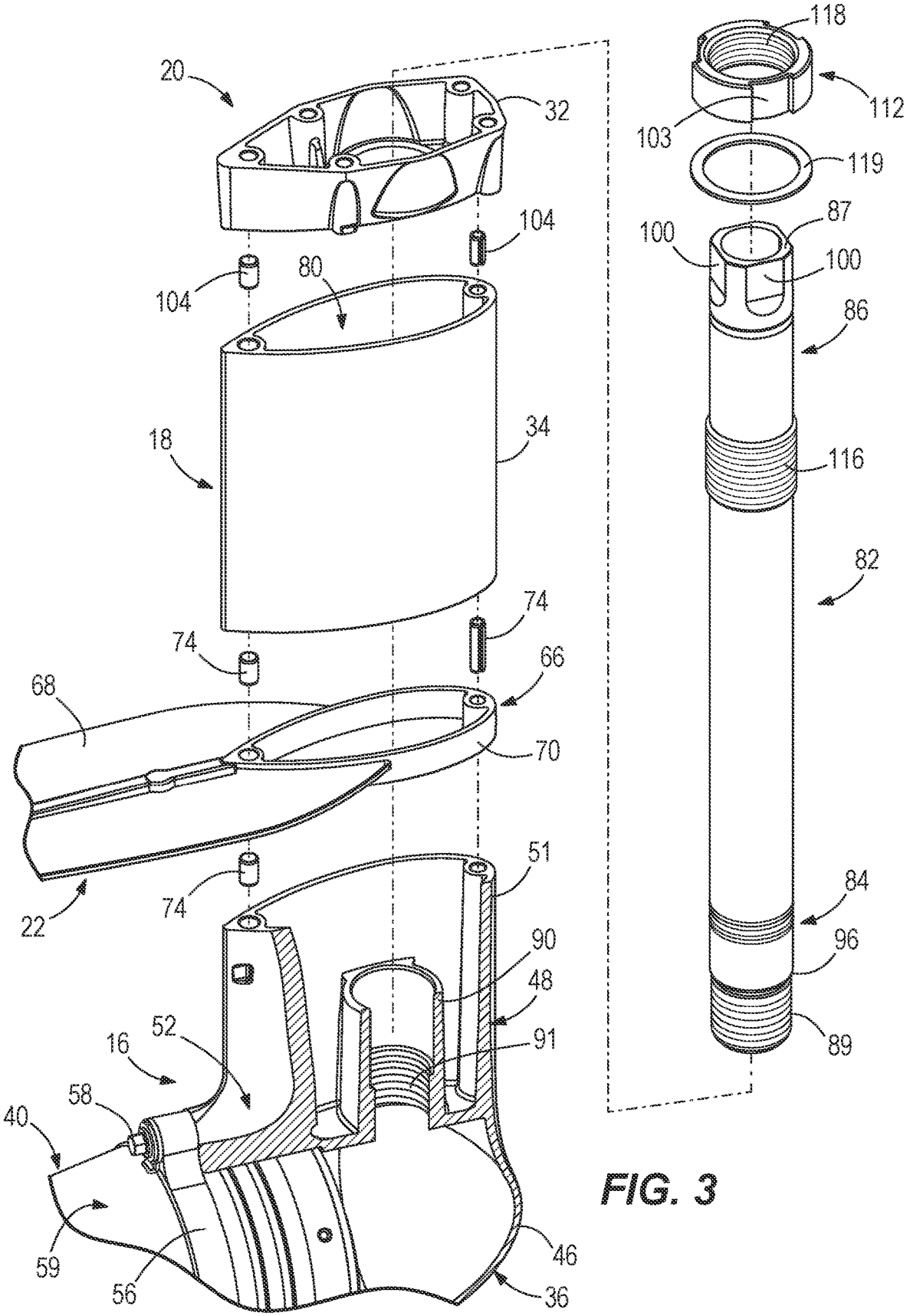
FIG. 3 is an exploded view of the lower unit of FIG. 1.

Referring to FIGS. 2 and 3, the anti-ventilation plate 22 has a head 66 at its forward end which is sandwiched between the extension leg 18 and the upwardly-facing gearcase housing portion 48 of the front gearcase housing 36. The head 66 has a tear-drop shaped perimeter sidewall 70 having a rounded forward end. The perimeter sidewall 70 is preferably monolithic so as to avoid external fasteners or other unsightly seams, or in other examples can be made of multiple pieces. The radially outer profile of the head 66 is foil-shaped or tear-drop shaped and generally matches the radially outer profile of the lower end of the extension leg 18 and also generally matches the radially outer profile of the upper end of the upwardly-facing gearcase housing portion 48, in particular such that these components together provide a smooth outer surface which is streamlined and encounters minimal hydrodynamic drag as the marine vessel travels through the water. Dowel pins 74 register and maintain the head 66 of the anti-ventilation plate 22 in alignment with the upwardly-facing gearcase housing portion 48 and the lower end of the extension leg 18. The dowel pins 74 extend through bores formed through the head 66 of the anti-ventilation plate 22 and into corresponding bores formed in the lower end of the extension leg 18 and corresponding bores the upper end of the upwardly-facing gearcase housing portion 48. The anti-ventilation plate 22 has a generally flat tail 68 which extends rearwardly from the head 66. The tail 68 extends rearwardly from both sides of the head 66.

Referring to FIGS. 2 and 3, the extension leg 18 is a sleeve having the perimeter sidewall 34 which defines a hollow interior 80. The sleeve is preferably monolithic to as to avoid externally visible fasteners or unsightly seam lines, or can be formed from multiple pieces. A hollow, axially elongated tube 82 is located in the hollow interior 80. The tube 82 has a lower end 84 which is fixedly coupled to the gearcase 16 and an upper end 86 which is coupled to the supporting frame 12 via a compression nut 112, which will be further described herein below. In a non-limiting example, the tube 82 is a monolithic aluminum tube. The hollow interior of the tube 82 provides a passageway for electrical connectors 121 extending from an upper portion of the marine drive 10 to the gearcase cavity 42, and for connection to the electric motor 44, i.e., for providing electricity to the electric motor 44 and/or for controlling the electric motor 44. The lower end 84 of the tube 82 is fixedly or rigidly coupled to the gearcase 16 by a threaded connection 88 comprising outer threads 89 on the outer diameter of the tube 82 and inner threads 91 on the inner diameter of a cylindrical stack 90 extending upwardly from a bottom wall 92 of the upwardly-facing gearcase housing portion 48. O-ring seals 94 provide a water-tight seal between the outer diameter of the tube 82 and the inner diameter of the cylindrical stack 90. A radially outer shoulder 96 on the lower end 84 of the tube 82 bottoms out on a radially inner shoulder 98 in the cylindrical stack 90 when the threaded connection 88 is fully engaged. The outer diameter of the tube 82 at the upper end 86 has flat surfaces 100 for engagement by a manual tool during installation, in particular for rotating the upper end 86 of the tube 82 relative to the gearcase 16 so as to complete the threaded connection 88.

The sidewall 32 of the adapter plate 20 has a radially outer profile that generally matches the radially outer profile of the upper end of the extension leg 18, in particular such that these components together provide a smooth outer surface which is streamlined and provides minimal hydrodynamic drag as the marine vessel travels through the water. Dowel pins 104 register and maintain the adapter plate 20 in alignment with upper end of the adapter plate 20. The dowel pins 104 extend into bores formed in the perimeter sidewall of the adapter plate 20 and into corresponding bores formed in the perimeter sidewall of the upper end of the extension leg 18. The adapter plate 20 has an interior abutment surface 110 that laterally and longitudinally extends between the inner diameter of the sidewall 32 of the adapter plate 20. As best seen in FIG. 2, the upper end 86 of the tube 82 axially extends out of the hollow interior 80 of the extension leg 18, through a hole in the interior abutment surface 110, and protrudes the interior passage 28 of the supporting frame 14. The interior abutment surface 110 extends entirely around the tube 82.

The noted compression nut 112 is engaged with the upper end 86 of the tube 82 via a threaded connection 114, and particularly as further explained herein below so as to clamp the extension leg 18 in place between the supporting frame 12 and the gearcase 16, thereby providing increased overall load carrying capability compared to the prior art and avoiding the use of fasteners that are visible from the exterior of the lower unit. The outer diameter of the upper end 86 of the tube 82 has threads 116. The inner diameter of the compression nut 112 has corresponding threads 118 for engaging the threads 116. Flats 103 are disposed around the outer perimeter of the compression nut 112 for engagement by a manual tool for rotating the compression nut 112 about the tube 82.

To assemble the lower unit, a washer 119 and the compression nut 112 are slid onto the upper end 86 of the tube 82 until the threads 118 engage the threads 116. The compression nut 112 is then rotated in the direction that causes the compression nut 112 to travel downwardly along the tube 82, via engagement between the threads 118, 116. Continued rotation of the compression nut 112 moves the compression nut 112 into compressing engagement with the top of the interior abutment surface 110 of the adapter plate 20. Thus, rotation of the compression nut 112 applies a compression force on the adapter plate 20, which in turn pulls the tube 82 and gearcase 16 axially upwardly. This firmly compresses and clamps the head 66 of the anti-ventilation plate 22 and the extension leg 18 between the gearcase 16 and bottom of the adapter plate 20 without the need for external fasteners and in an improved load-bearing arrangement. Advantageously the entire arrangement can be easily assembled in an efficient manner.

An anti-ventilation plate is sandwiched between the extension leg and the upper opening of the gearcase. A motor in the gearcase, the motor being configured to rotate the propulsor. The tube provides a passageway for electrical connectors extending into the gearcase for connection to the motor. The lower end of the tube is fixed to the gearcase by a threaded connection comprising outer threads on the tube and inner threads on the gearcase.

In certain examples, the extension leg is a monolithic sleeve and the tube in the extension leg is a monolithic aluminum tube.

Figure 4:
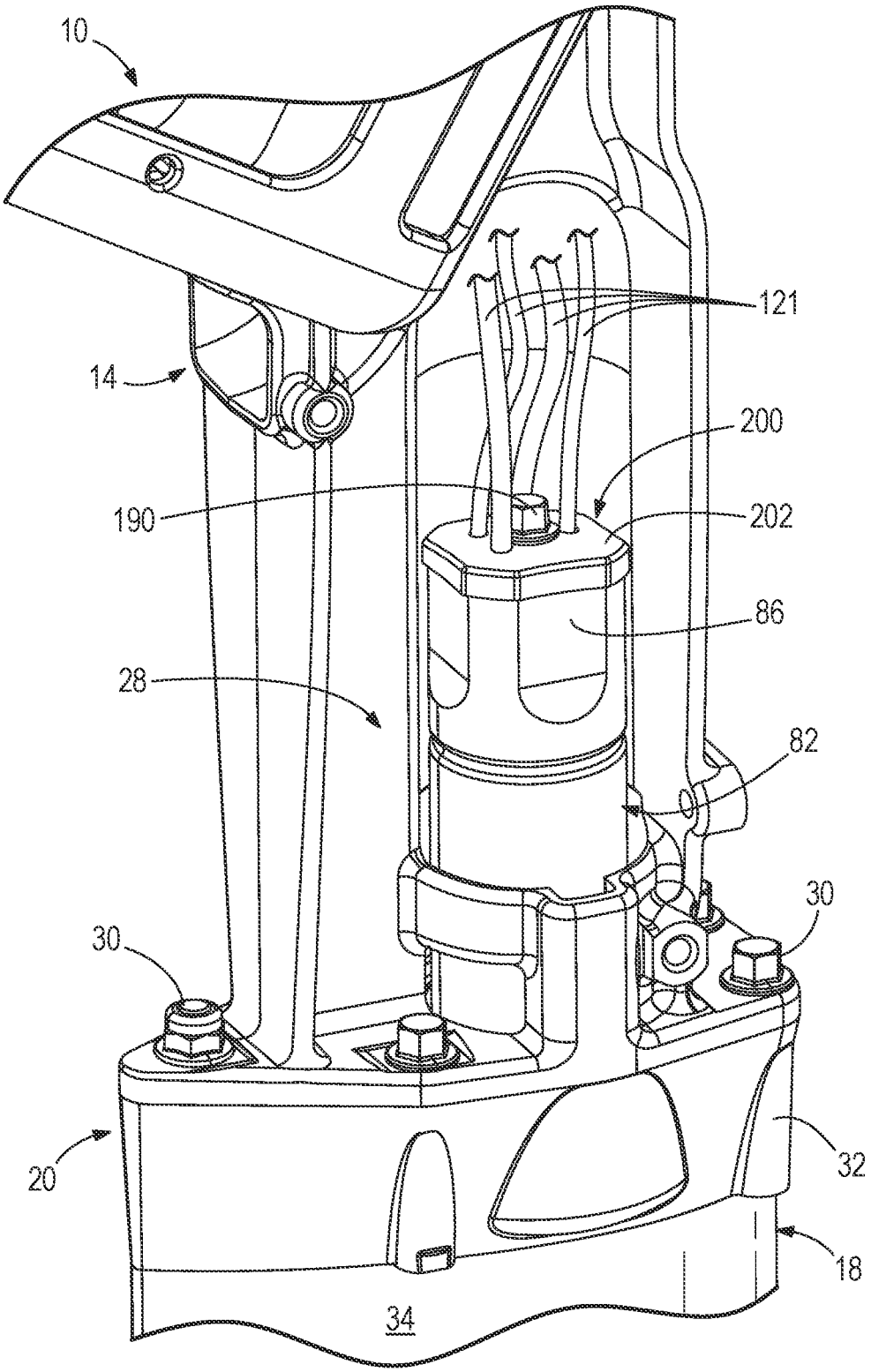
FIG. 4 is a detailed perspective view of a marine drive with a seal device for the tube 82 extending from the extension leg.

As illustrated in FIG. 4, embodiments of a marine drive 10 may include a novel seal device 200 configured to provide a watertight seal between the axially elongated tube 82 and any electrical connector(s) 121 extending though tube 82. The upper end 86 of the tube 82 (or an extension 194 thereof) protrudes out of the extension leg 18 and the seal device 150 is positioned on the upper end 86 of the tube 82.

Figure 5:
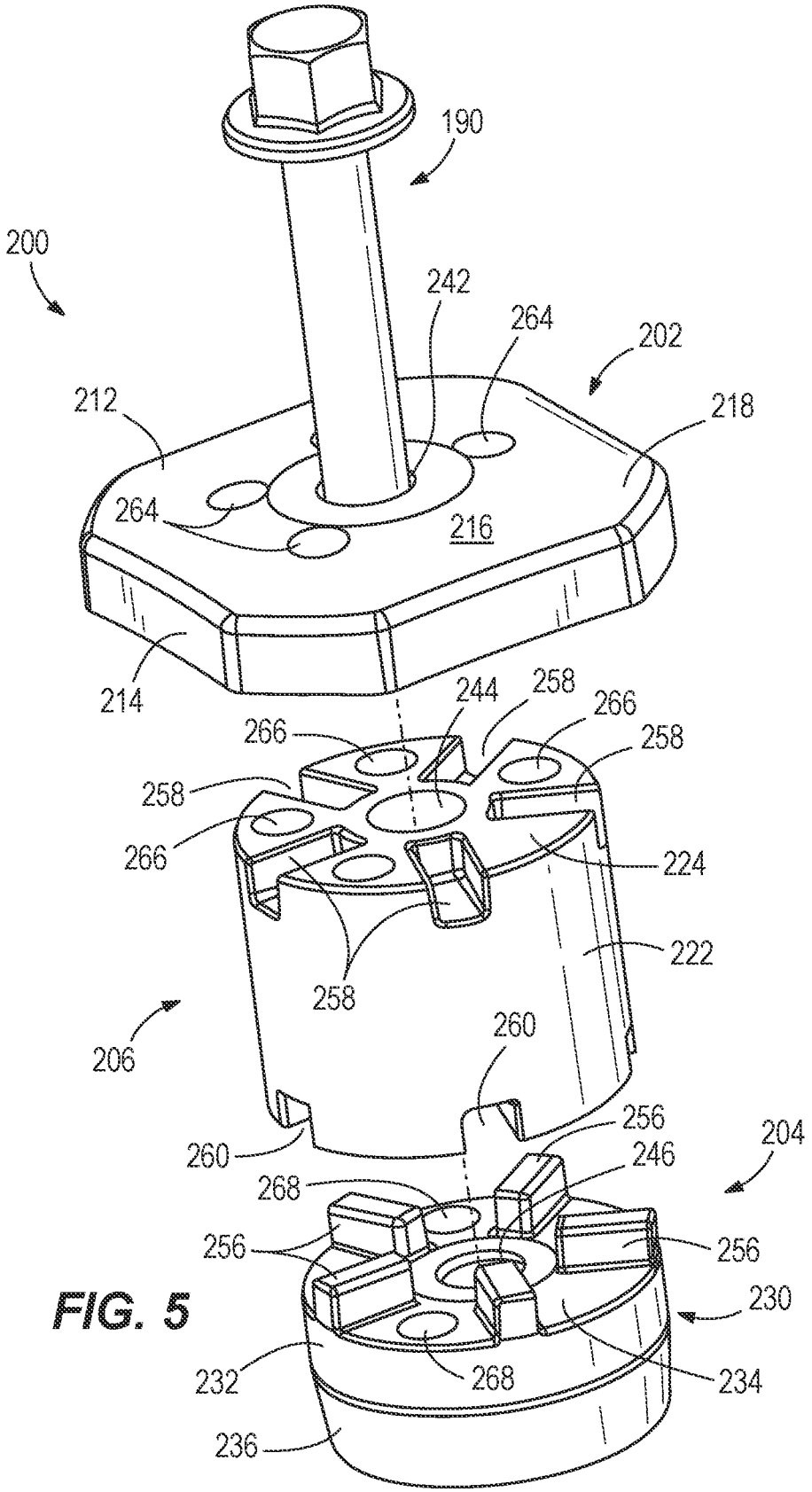
FIG. 5 is an exploded view of the seal device of FIG. 4.
Figure 6:
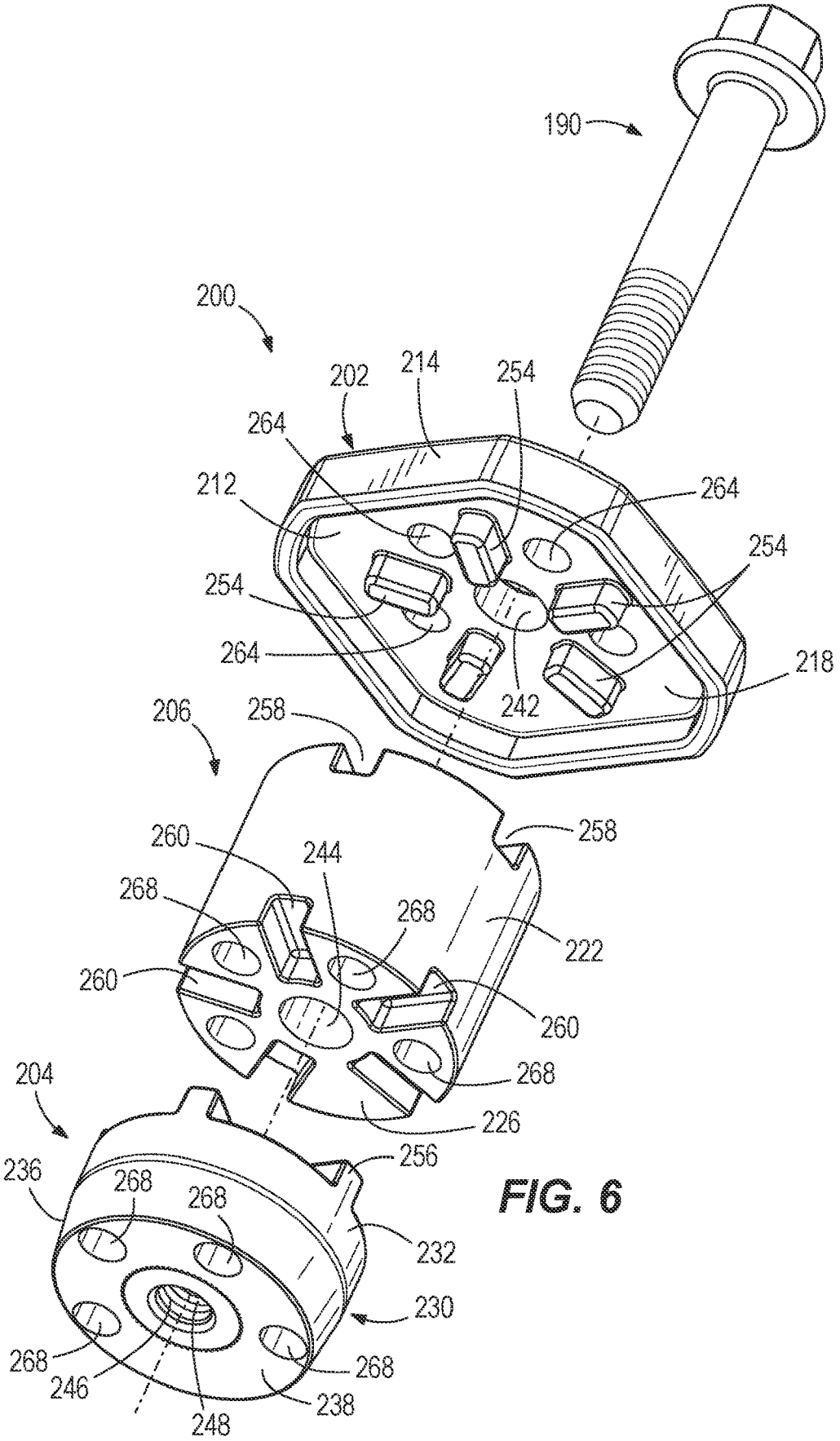
FIG. 6 is another exploded view of the seal device of FIG. 5.

Referring to FIGS. 5 and 6, the seal device 200 includes two rigid members-a top cap 202 and an end cap 204—and an elastomeric member 206 axially sandwiched between the two rigid members 202, 204. The top cap 202 has a generally planar body 212 with a downwardly extending peripheral wall 214 extending around the perimeter of the body 212. In the non-limiting illustrated embodiments, the body 212 is configured to be seated on an upper perimeter 87 of the upper end of the tube 82 such that the perimeter wall 214 extends around the upper perimeter 87 of the tube 82. The elastomeric member 206 has a cylindrical body 222 with a top surface 224 and an opposing bottom surface 226. The cylindrical body 222 is made of a flexible material such as rubber and is resilient so that it is able to deform under pressure but tends to retain the shape shown in FIGS. 5 and 6. The top surface 224 of the cylindrical body 222 is seated against the lower surface 216 of the top cap 202, and the bottom surface 226 of the cylindrical body 222 is seated against an upper surface 234 of the end cap 204. The end cap 204 has a body 230 with a cylindrical portion 232 and a tapered portion 236 positioned below the cylindrical portion 232. The cylindrical portion 232 provides the upper surface 234 of the end cap 204 and a tapered portion 236 and has an outer perimeter that generally matches the outer perimeter of the elastomeric member 206. The tapered portion 236 has an outer perimeter that tapers radially inward from to cylindrical portion to the lower surface 238 of the end cap 204.

To couple the top cap 202 and end cap 204 to the elastomeric member 206, a fastener 190 extends through the rigid members 202, 204 and the elastomeric member 206. In particular, the fastener 190 extends through a center bore 242 formed through the top cap 202, a center bore 244 formed through the elastomeric member 206, and a center bore 246 formed through the end cap 204. The fastener 190 engages internal threads 248 to couple the top cap 202, elastomeric member 206, and end cap 204 together. In the illustrated embodiments, the internal threads 248 are formed in a threaded insert 250 that is fixedly secured in the center bore 246 of the end cap 204. Other embodiments, however, may include an end cap with integrally formed threads for engaging the fastener.

In the non-limiting illustrated embodiments, the cylindrical body 222 of the elastomeric member 206 is mated with the bodies 212, 230 of the rigid members 202, 204 by at least one tab and at least one slot such that the cylindrical body 222 is prevented from rotating relative to the rigid members 202, 204. With continued reference to FIGS. 5 and 6, the lower surface 216 of the top cap 202 and the upper surface 234 of the end cap 204 each include a plurality of tabs 254, 256 configured to be nested in corresponding slots 258, 260 formed in the cylindrical body 222 of the elastomeric member 206. The illustrated top cap 202 includes five radially extending tabs 254 that are spaced around the center bore 242 and project downwardly from the lower surface 216 thereof. Each of the tabs 254 is nested in a corresponding slot 258 that is formed in the top surface 224 of the elastomeric member 206 and extends radially inward from the outer perimeter of the cylindrical body 222, thereby preventing rotation of the top cap 202 relative to the elastomeric member 206. The end cap 204 similarly includes five radially extending tabs 256 that project upwardly from the upper surface 234 of the end cap 204. Each of the tabs 256 is nested in a corresponding radially extending slot 260 that is formed in the bottom surface 226 of the elastomeric member 206. The slots 260 formed in the bottom surface 226 are spaced around the center bore 244 through the cylindrical body 222 so that the slots 260 are aligned with the slots 258 formed in the top surface 224. Thus, the cylindrical body 222 is reversable with a top surface 224 that is generally the same as the bottom surface 226. In some embodiments, however, an elastomeric member may be configured with at least one slot in a top surface or bottom that is not aligned with a slot formed in the other one of the top or bottom surfaces. Additionally or alternatively, some embodiments may include a different number of corresponding slots and tabs for mating the top cap and/or the end cap to the elastomeric member.

The top cap 202, the end cap 204, and the elastomeric member 206 each include at least one through-bore configured so that an electrical connector 121 extends axially through the seal device. In the illustrated embodiment, the elastomeric member 206 includes four through-bores 266 that extend through the cylindrical body 222 from the top surface 224 to the bottom surface 226. The through-bores 266 are spaced around the center bore 244 and positioned between the radially extending slots 258, 260. The top cap 202 and the end cap 204 each include a set of through-bores 264, 268, and each of the bores 264, 268 corresponds to one of the through-bores 266. When the radially extending tabs 254, 256 are received in the radially extending slots 258, 260, the through-bores 264 in the top cap 202 and the through-bores 268 in the end cap 204 are aligned with the through-bores in the elastomeric member 206. The illustrated seal device 200 is configured to receive four electrical connectors 121 that extend therethrough. Other embodiments, however, may be configured to accommodate a different number of electrical connects and may include a different number of corresponding through-bores in the rigid members 202, 204 and the elastomeric member 206.

Figure 8:
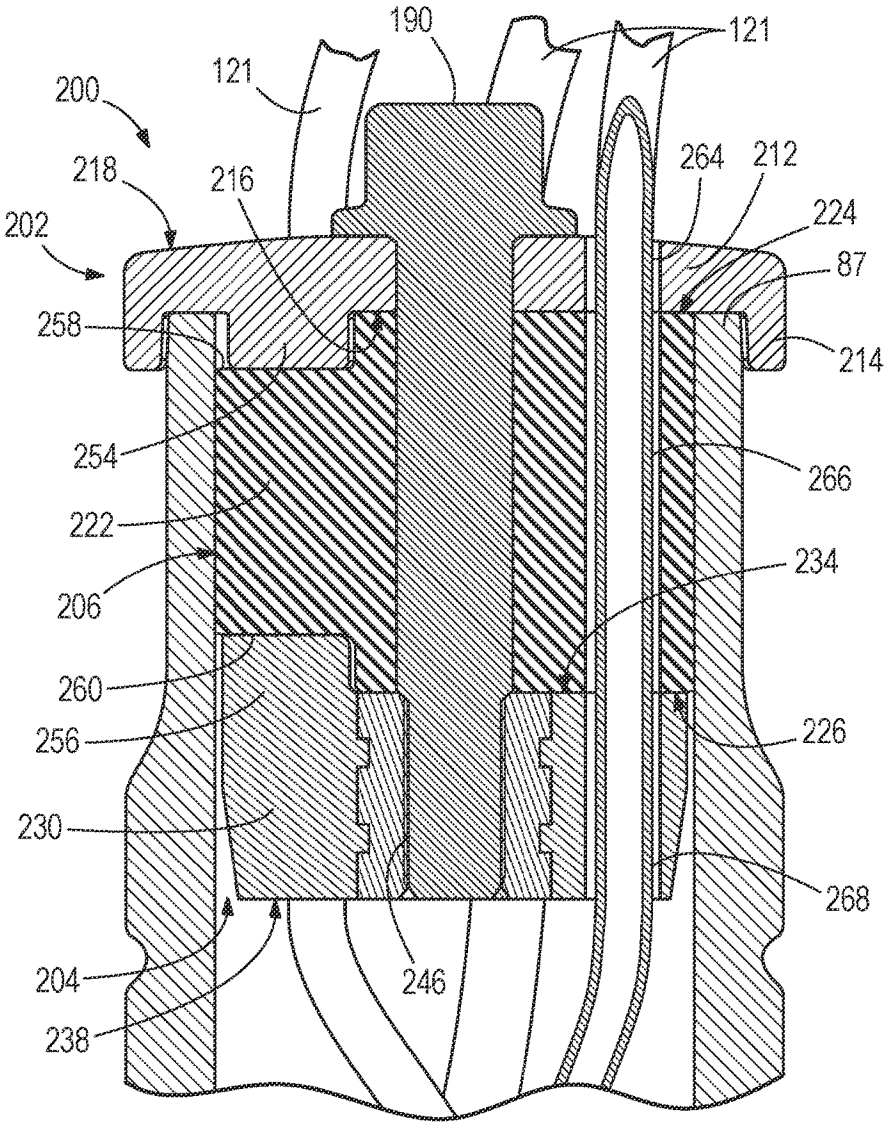
FIG. 8 is a view of section 8-8, taken in FIG. 7.
Figure 7:
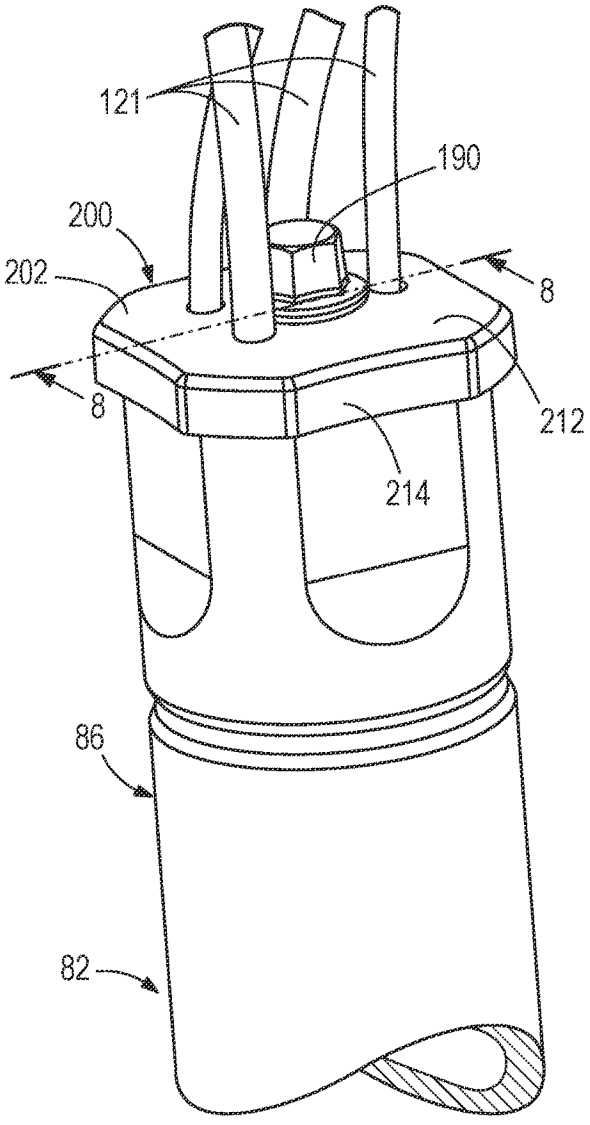
FIG. 7 is a detailed perspective view of the seal device installed in the tube of FIG. 4.

Referring to FIGS. 7 and 8, the seal device 200 is installed by mating the elastomeric member 206 to the rigid members 202, 204 by nesting the tabs 254, 256 in the corresponding slots 258, 260 and inserting the fastener 190 through the center bores 242, 244, 246. The fastener 190 is engaged with the threads 248 to loosely sandwich the elastomeric member 206 between the two rigid members 202, 204, and the electrical connectors 121 are inserted through the seal device 200 through the respective through-bores 264, 266, 268. The seal device 200 is placed on the upper end 86 of the tube 82 by inserting the lower end of the seal member 200 into the tube 82 such that the cylindrical body 222 of the elastomeric member 206 and the end cap 204 are positioned in the tube 82 and the top cap 202 sits on the top end 86 of the tube 82.

Once the seal device 200 is positioned on the tube 82, the fastener 190 is tightened to compress the two rigid members 202, 204 on the elastomeric member 206. Compression of the rigid members 202, 204 on the elastomeric member 206 causes the elastomeric member 206 to radially inwardly and outwardly expand, and thereby providing a watertight seal between the electrical connectors 121 and a radially inner surface of the tube 82 or an extension thereof. In particular, as the elastomeric member 206 is compressed between the top cap 202 and the end cap 204, the elastomeric member 206 expands radially outward to form a seal between the radially outer surface of the cylindrical body 222 and the radially inner surface of the tube 82. Compression of the elastomeric member 206 additionally causes the through-bores 266 in the cylindrical body 222 to radially collapse and seal against the electrical connectors 121, thereby sealing the top end 86 of the tube 82.

Figure 9:
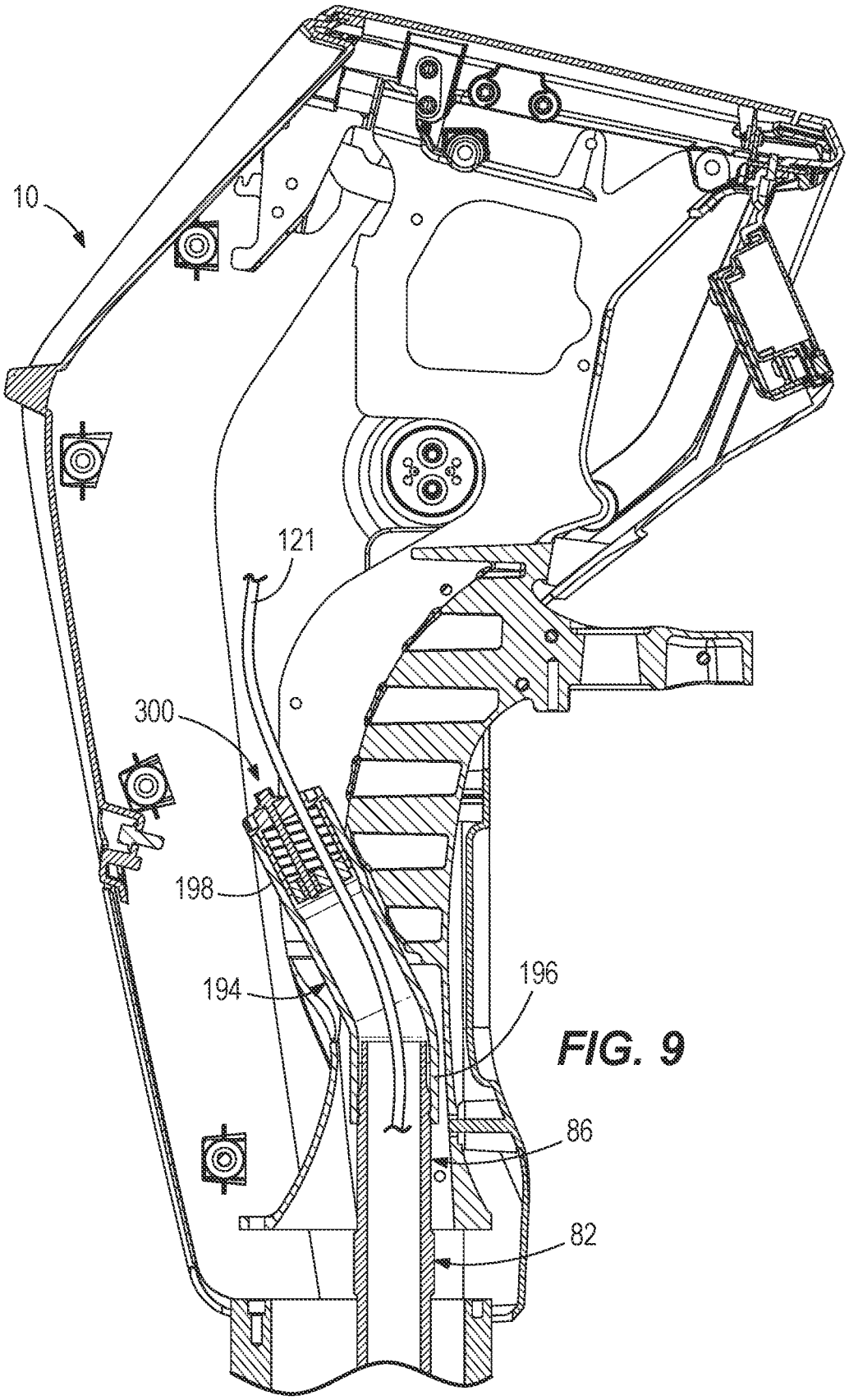
FIG. 9 is a cross-sectional view of an embodiment of a marine drive with another example of a seal device.

As previously mentioned, some embodiments of a marine drive may include an extension of the tube which extends into the interior of the cowling. For example, as illustrated FIGS. 9, embodiments of a marine drive 10 may include a tube extension 194 coupled to the top end 86 of the tube 82 and a seal device 300 configured to provide a watertight seal between the electrical connector and the tube extension to prevent infiltration of water to the gearcase 42. In the illustrated embodiment, the tube extension 194 is flexible and include a lower end 196 that extends around the upper end 86 of the tube 82 and an upper end 198 that receives the seal device 300.

Figure 10:
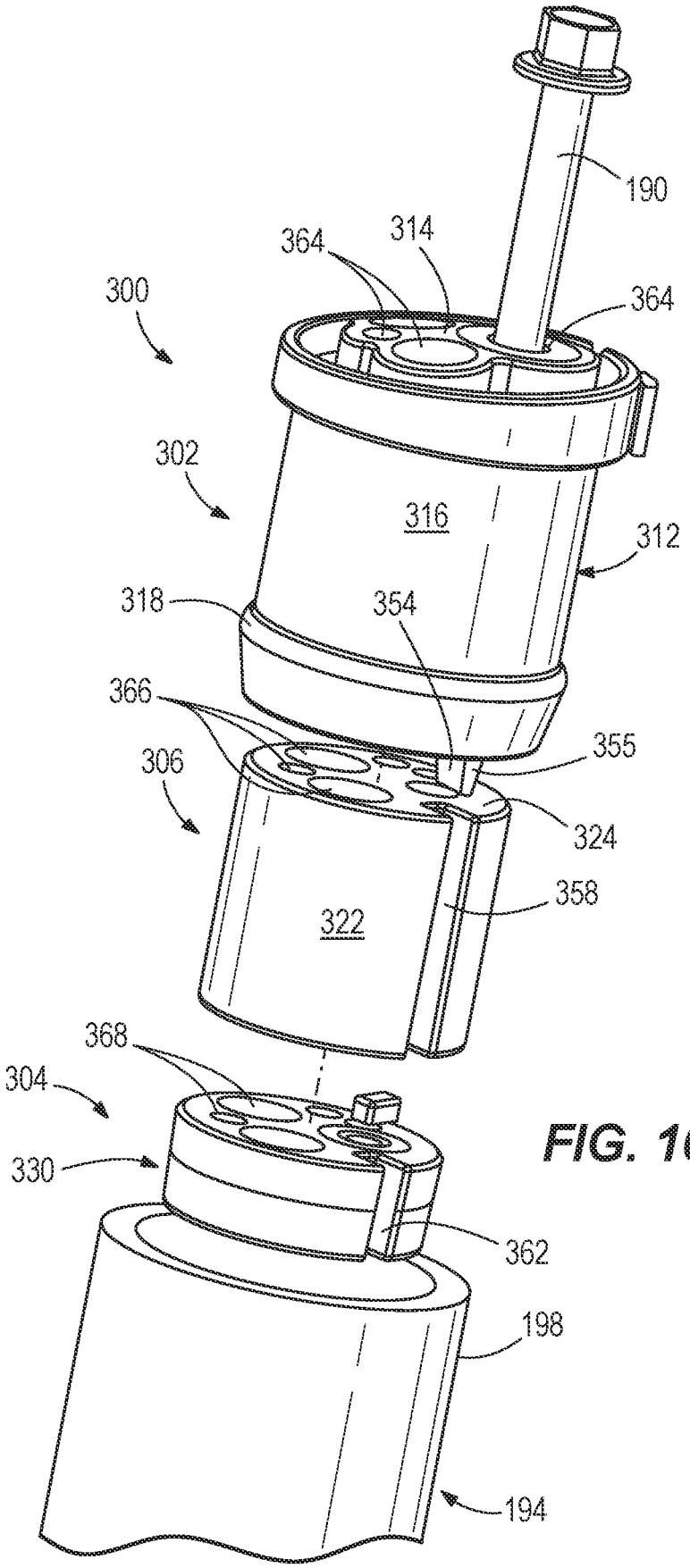
FIG. 10 is an exploded view of the seal device of FIG. 9.
Figure 12:
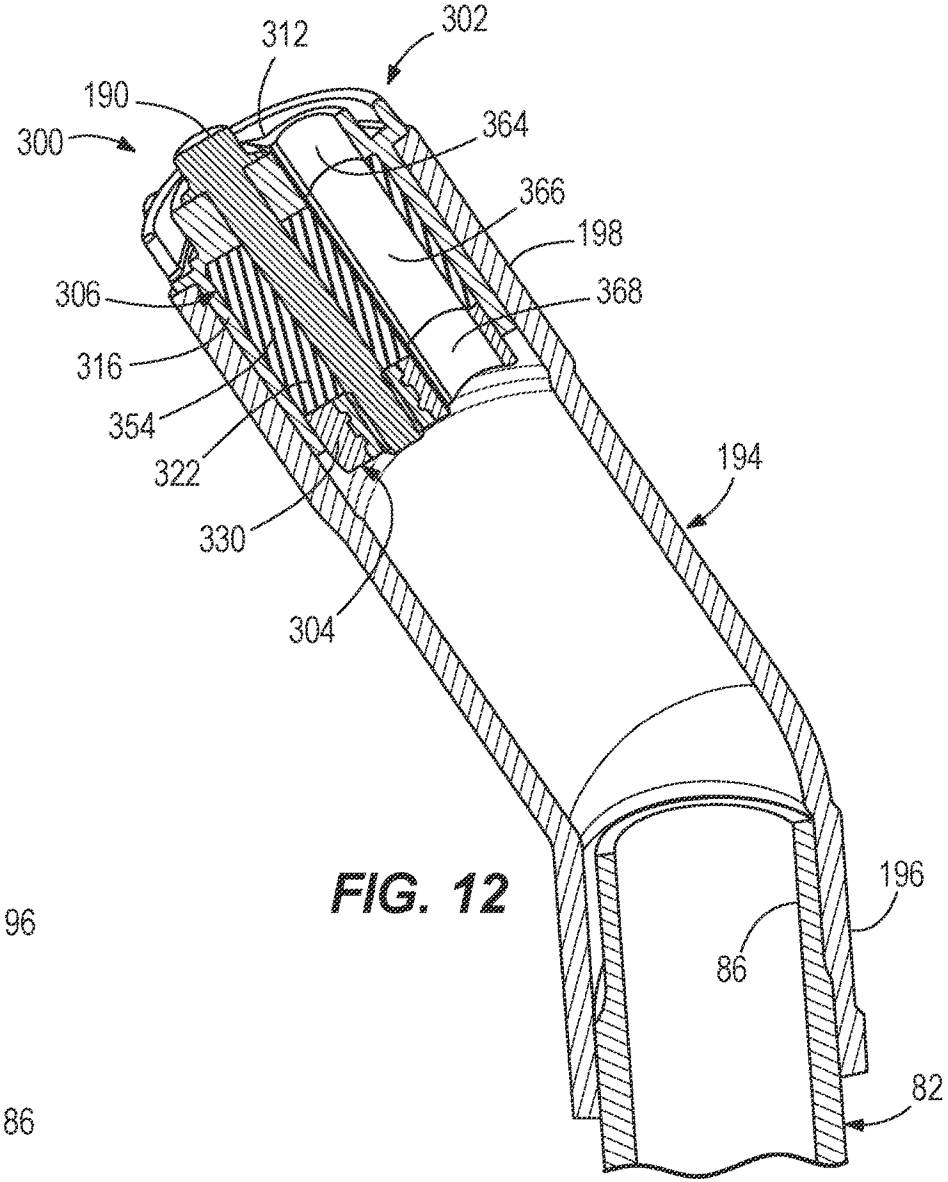
FIG. 12 is a view of section 12-12, taken in FIG. 11.
Figure 11:
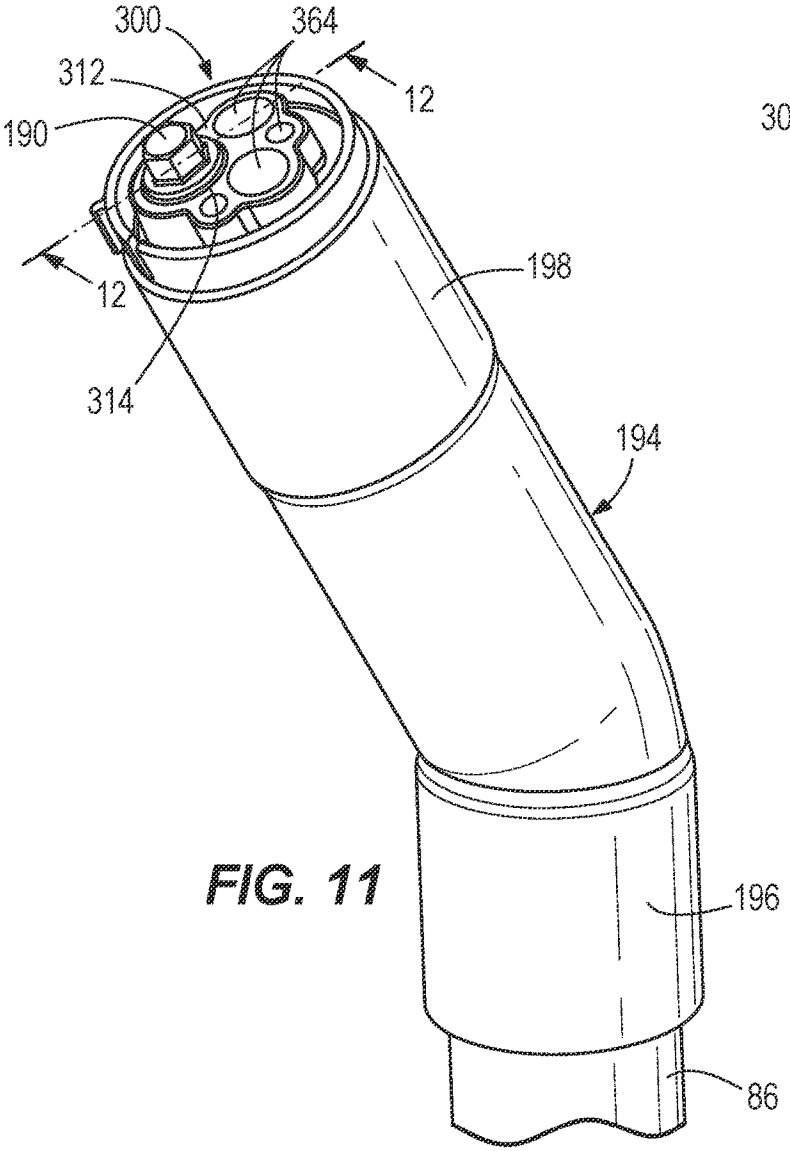
FIG. 11 is a detailed perspective view of the seal device installed in the tube of FIG. 9.

Referring to FIGS. 10-12, the seal device 300 includes a top cap 302 with a tubular body 312, an elastomeric member 306, and a rigid end cap 304. The tubular body 312 includes a top wall 314 at an upper end thereof and a tubular portion 316 which provides a radially inner surface and a radially outer surface. A radially outer barb 318, which is configured for sealing with an interior surface of the tube extension 194, extends circumferentially around the tubular body 312 and projects outward from the radially outer surface. A positioning tab 354 extends axially along the radially inner surface of the cylindrical body 312 from the top wall 314 to a lower end 355 that extends past the lower edge of the cylindrical portion 323.

The elastomeric member 306 has a cylindrical body 322 configured to be received in the tubular body 312 of the top cap 302. A positioning slot 358 is formed into the side of the cylindrical body 322 and extends axially from a top surface 324 of the cylindrical body 322 to a bottom surface 326. The positioning slot 358 is configured to receive the positioning tab 354 such that the positioning tab 354 is nested within the positioning slot 358, thereby mating the top cap 302 to the elastomeric member 306 and preventing rotation therebetween. The end cap 304 has a cylindrical body 330 and is received in the tubular body 312 of the top cap 302 below the elastomeric member 306, thereby sandwiching the elastomeric member between the top cap 302 and the end cap 304. The end cap 304 similarly includes an axially extending positioning slot 362 that is formed into the side of body 330 of the end cap 304. The lower end 355 of the positioning tab 354 is nested within the positioning slot 362 to prevent rotation of the end cap 304 relative to the top cap 302 and elastomeric member 306.

The rigid members 302, 304 and elastomeric member 306 include corresponding through-bores 364, 366, 368 extending through the top cap 302, end cap, 304, and elastomeric member 306. Engagement between the positioning tab 354 and the positioning slots 358, 362 maintains alignment of the through-bores 364, 366, 368 so that electrical connectors and a fastener 190 may be inserted through the seal device 300. In the non-limiting embodiments of FIGS. 9-12, the seal device 300 includes three large through-bores and two small large through-bores extending through rigid members 302, 304 and the elastomeric member 306. The large through-bores may be dimensioned to receive the fastener 190 or a large diameter connector, and the small through-bores may be dimensioned to receive a small diameter connector. However, it should be appreciated that some embodiments of a seal device may include a different arrangement of through-bores.

As illustrated in FIGS. 11 and 12, the assembled seal device 300 is installed by inserting the cylindrical body 312 of the top cap 302 into the top end 198 of the tube extension 194. The radially outer surface of the cylindrical body 312 and the radially outer barb 318 form a seal against the radially inner surface of the tube extension 194. When the fastener 190 is tightened, the elastomeric member 306 is compressed by the top cap 302 and the end cap 304, thereby causing the elastomeric member 306 to radially inwardly and outwardly expand. The radially outer surface of the cylindrical body 322 expands outward to form a seal against the radially inner surface of the tubular body 312 of the top cap 302, and the through-bores 366 of the elastomeric member collapse to form a seal against the connectors extending through the through-bores 366.

While the seal device 200 of FIGS. 4-8 is illustrated as sealing the top end 86 of the tube 82 and the seal device 300 of FIGS. 9-12 is illustrated as sealing the top end 198 of the extension 194 of the tube 82, it should be appreciated that the seal devices 200, 300 are interchangeable.

The embodiments described herein above advantageously provide a sealed motor cavity with a sealed conduit extending up above the normal water line, into the cowling interior. Embodiments of the novel seal device may be easily assembled and provides a resealable watertight seal between the tube and any electrical connectors extending from the frame into the gearcase, thereby preventing infiltration of water to the gearcase. Generally, the present invention thus provides a reduction of water intrusion to the motor cavity and provides a simple means to verify assembly processes/failure modes In the present description, certain terms have been used for brevity, clarity, and understanding. No unnecessary limitations are to be implied therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims.

What is claimed is:

1. A marine drive comprising:
a supporting frame,
a gearcase configured to support a propulsor for propelling the marine drive,
an electric motor in the gearcase, the electric motor being operably coupled to the propulsor,
an extension leg between the supporting frame and the gearcase,
a tube in the extension leg,
an electrical connector extending from the tube to the gearcase, the electrical connector being operably coupled to the electric motor, and
a seal device in the tube or an extension thereof, the seal device having an elastomeric member, wherein the seal device is operable to compress the elastomeric member to provide a radial seal between the electrical connector and the tube or the extension thereof to prevent infiltration of water to the gearcase.

2. The marine drive according to claim 1, wherein the radial seal is between the electrical connector and a radially inner surface of the tube or the extension thereof.

3. The marine drive according to claim 2, wherein the seal device includes rigid members and wherein compression of the rigid members on the elastomeric member causes the elastomeric member to expand radially inwardly and radially outwardly to provide the radial seal.

4. The marine drive according to claim 3, further comprising a fastener extending through the elastomeric member, wherein tightening the fastener compresses the rigid members on the elastomeric member.

5. The marine drive according to claim 3, wherein the elastomeric member includes a cylindrical body that is mated with the rigid members such that the cylindrical body is prevented from rotating relative to the rigid members.

6. The marine drive according to claim 5, wherein the cylindrical body is mated with the rigid members by at least one tab and at least one slot.

7. The marine drive according to claim 5, wherein the cylindrical body is mated with the rigid members by radially extending tabs that are nested in radially extending slots.

8. The marine drive according to claim 3, wherein the rigid members include a top cap on an upper end of the tube or the extension thereof and an end cap in the tube or the extension thereof.

9. The marine drive according to claim 8, wherein the top cap is seated on an upper perimeter of the upper end of the tube or the extension thereof and a perimeter wall of the top cap extends around the upper perimeter.

10. The marine drive according to claim 9, wherein the tube is a monolithic aluminum tube.

11. The marine drive according to claim 8, wherein the top cap includes a tubular body having a radially outer barb for sealing with an interior surface of the extension of the tube.

12. The marine drive according to claim 11, wherein the extension of the tube is flexible.

13. The marine drive according to claim 11, wherein the end cap is disposed in the tubular body and wherein said compression causes the elastomeric member to seal with a radially inner diameter of the tubular body.

14. The marine drive according to claim 3, wherein the elastomeric member comprises a through-bore through which the electrical connector extends, and wherein compression of the rigid members on the elastomeric member causes the through-bore to radially collapse and seal against the electrical connector.

15. The marine drive according to claim 3, wherein the electrical connector is one of a plurality of electrical connectors and wherein the elastomeric member includes a plurality of through-bores through which the plurality of electrical connectors extend, and wherein compression of the rigid members on the elastomeric member causes the plurality of through-bores to radially collapse and seal against the plurality of electrical connectors.

16. A marine drive comprising:

a supporting frame for coupling the marine drive to a marine vessel, a gearcase configured to support a propulsor for propelling the marine vessel in water, an electric motor in the gearcase, the electric motor being configured to rotate the propulsor, an extension leg between the supporting frame and the gearcase, a tube in the extension leg, the tube having a lower end coupled to the gearcase, an electrical connector extending through the tube and providing power to the electric motor, and a seal device providing a watertight seal between the electrical connector and the tube or an extension thereof to prevent infiltration of water to the gearcase, wherein an upper end of the tube or the extension thereof protrudes out of the extension leg and wherein the seal device is on the upper end of the tube or the extension thereof.

17. A marine drive comprising:

a supporting frame for coupling the marine drive to a marine vessel, a gearcase supporting a propulsor for propelling the marine vessel in water, an electric motor in the gearcase, the electric motor being configured to rotate the propulsor, an extension leg between the supporting frame and the gearcase, a tube in the extension leg, the tube having a lower end coupled to the gearcase, a plurality of electrical connectors extending through the tube and configured to provide power to the electric motor, a seal device providing a watertight seal between the plurality of electrical connectors and the tube or an extension thereof to prevent infiltration of water to the gearcase, the seal device comprising rigid members and an elastomeric member that is axially between the rigid members, wherein compression of the rigid members causes the elastomeric member to radially inwardly and outwardly expand and thereby-provide the watertight seal, and a fastener extending through the elastomeric member, wherein tightening the fastener compresses the rigid members on the elastomeric member.

18. The marine drive according to claim 17, wherein the elastomeric member includes a cylindrical body that is mated with the rigid members such that the cylindrical body is prevented from rotating relative to the rigid members.

19. The marine drive according to claim 18, wherein the cylindrical body is mated with the rigid members by at least one tab and at least one slot.

20. The marine drive according to claim 18, wherein the cylindrical body is mated with the rigid members by radially extending tabs that are nested in radially extending slots.

21. The marine drive according to claim 16, further comprising a cowling having a cowling interior, wherein the upper end of the tube or the extension thereof is accessible in the cowling interior.

* * * * *